United States Patent [19]

Akesaka

[11] 4,406,498

[45] Sep. 27, 1983

[54] SHIELD TUNNELING METHOD AND MACHINE THEREFOR

[75] Inventor: Toshio Akesaka, Yokohama, Japan

[73] Assignee: Kabushiki Kaisha Iseki Kaihatsu Koki, Japan

[21] Appl. No.: 272,059

[22] Filed: Jun. 9, 1981

[30] Foreign Application Priority Data

Jun. 30, 1980 [JP] Japan ..... 55-87816
Oct. 29, 1980 [JP] Japan ..... 55-150829

[51] Int. Cl.[3] ..... E21D 9/08

[52] U.S. Cl. ..... 299/11; 299/18; 299/33; 405/144

[58] Field of Search ..... 299/11, 18, 33; 405/144

[56] References Cited

U.S. PATENT DOCUMENTS

| | | | |
|---|---|---|---|
| 1,720,195 | 7/1929 | App | 299/18 X |
| 3,378,305 | 4/1968 | Geldmacher et al. | 405/144 X |
| 3,561,223 | 2/1971 | Tabor | 405/144 |
| 3,743,356 | 7/1973 | Sheets | 299/18 |
| 4,068,484 | 1/1978 | Iwamitu et al. | 405/144 |
| 4,298,230 | 11/1981 | Krabbe | 299/33 |

*Primary Examiner*—Ernest R. Purser

*Attorney, Agent, or Firm*—Kane, Dalsimer, Kane, Sullivan and Kurucz

[57] ABSTRACT

A method for excavating a tunnel wherein the muck from the tunnel face is admitted into the shield; the muck is pressed by a pressure of a predetermined level higher than an active earth pressure in the face and lower than a passive earth pressure as the shield body is moved forward, thereby establishing the balance between the earth pressure in the face ground and the muck pressure; and a liquid of a level balancing the underground water pressure is used to resist the underground water, thereby preventing movement of the underground water, whereby the face is maintained stable; and when the muck pressure is raised over the predetermined level, the muck is discharged out of the shield. A shield tunneling machine embodying the above described method comprises a cutter head (24,124) allowing the passing of the muck therethrough, a diaphragm (14,114) provided in the shield body (10,110), a muck inlet (16,116) provided in the diaphragm, a cover member (50,148,149) adapted to open and close the muck inlet and coupled to an operating means (52,160) presetting the muck pressure at the aforesaid predetermined level, and a muck chamber provided behind the diaphragm and usually charged with a liquid.

12 Claims, 9 Drawing Figures

SHIELD TUNNELING METHOD AND MACHINE THEREFOR

BACKGROUND OF THE INVENTION

This invention relates to a shield tunneling method and a machine therefor, which excavate a tunnel by causing a pressure to act on the tunnel face, while preventing collapse of the tunnel face, the pressure being such a level as balances an earth pressure and underground water pressure in the face ground.

One of the known methods of preventing collapse of the tunnel face in excavating a tunnel is to apply a pressure with sludge, such as bentonite slurry, to the face, as disclosed in U.S. Pat. No. 3,946,605. The other method is to apply a pressure to the face with muck from the tunnel face, as disclosed in U.S. Pat. No. 4,167,289.

The former can effectively resist the underground water, but, in the ground of a high permeability, such as sandy ground, can not independently resist the face earth pressure. The latter has been difficult in resisting a water pressure in the ground in which the underground water level is high.

With a view to solving the drawback of the conventional method and machine, it is an object of the present invention to provide tunneling method and machine for excavating a tunnel against an earth pressure and a water pressure in the face ground while maintaining the face stable, irrespective of the nature of soil in the face ground or the underground water level being high or low.

Regarding stability of the tunnel face, the inventor came to such a conclusion to be described below. If the mined material or muck from the tunnel face is directly urged against the tunnel face so that a muck pressure can balance the earth pressure in the tunnel face, then the tunnel face becomes stabilized as in the ground under the natural condition. On the other hand, a liquid is pressurized to such a level as making an equilibrium with the level of the underground water pressure, so as to resist the underground water, and to impede movement of the underground water. The underground water thus can be maintained in a condition similar to the natural condition. By the use of the muck and liquid which are pressurized to such a level as balancing the earth pressure in the face ground and the underground water pressure, stability of the tunnel face is extremely rationally maintained. If the muck alone can be taken out of the tunnel face, without taking underground water out of the tunnel face or moving same, then excavation of a tunnel can be safely and efficiently proceeded with, without impairing stability of the tunnel face.

In accordance with the theory described above, improvements in a conventional shield tunneling method and machine are made, for attaining the object described above.

SUMMARY OF THE INVENTION

According to the present invention, a pressure of a predetermined level higher than an active earth pressure in the face ground but lower than a passive earth pressure is caused to act beforehand on a cover member adapted to open and close a muck inlet provided in a diaphragm, and only when a reaction force of the muck from the tunnel face which receives a pressure from the diaphragm and which acts on the diaphragm and the cover member for closing the muck inlet is increased over the predetermined level, the muck is introduced into a muck chamber located at the rear of the diaphragm and usually charged with a liquid. The pressure drop commensurate to an amount of earth and sand discharged occurs ahead of the diaphragm, and when the pressure drops to less than the predetermined level, the muck inlet is again closed by the cover member. Since the equilibrium of the underground water pressure and the pressure of a liquid in the muck chamber is maintained for this duration, the underground water by no means moves. Thus, excavation of a tunnel and discharge of the muck from the tunnel face are proceeded, without a risk that a degree of the filling of the muck in the region between the face and the diaphragm is reduced and without lowering the underground water pressure, namely, without causing substantial lowering of a pressure against the tunnel face. During excavation, the shield body may be usually pressed in a direction of thrusting a shield, without a need of providing a special thrust controlling means. The shield body thus can be moved forward while preventing collapse of the face. The cover member is so arranged as to open the muck inlet as a pressure of the muck existing at the front of the diaphragm and close the muck inlet as the pressure of the muck is lowered to a predetermined level, so that excavation of a tunnel may be automated with ease.

According to the present invention, gravels contained in the muck are received in the muck crushing chamber located at the rear of the diaphragm and charged with a liquid, receive impact by a crushing rotor, thereby being crushed into pieces, and are discharged from the lower portion of the chamber. The muck inlet is provided in the upper portion of the diaphragm, and the muck charged into the crushing chamber drops on the rotor, and is crushed by the crushing force of the rotor.

DESCRIPTION OF THE PREFERRED EMBODIMENTS

Figure 1:
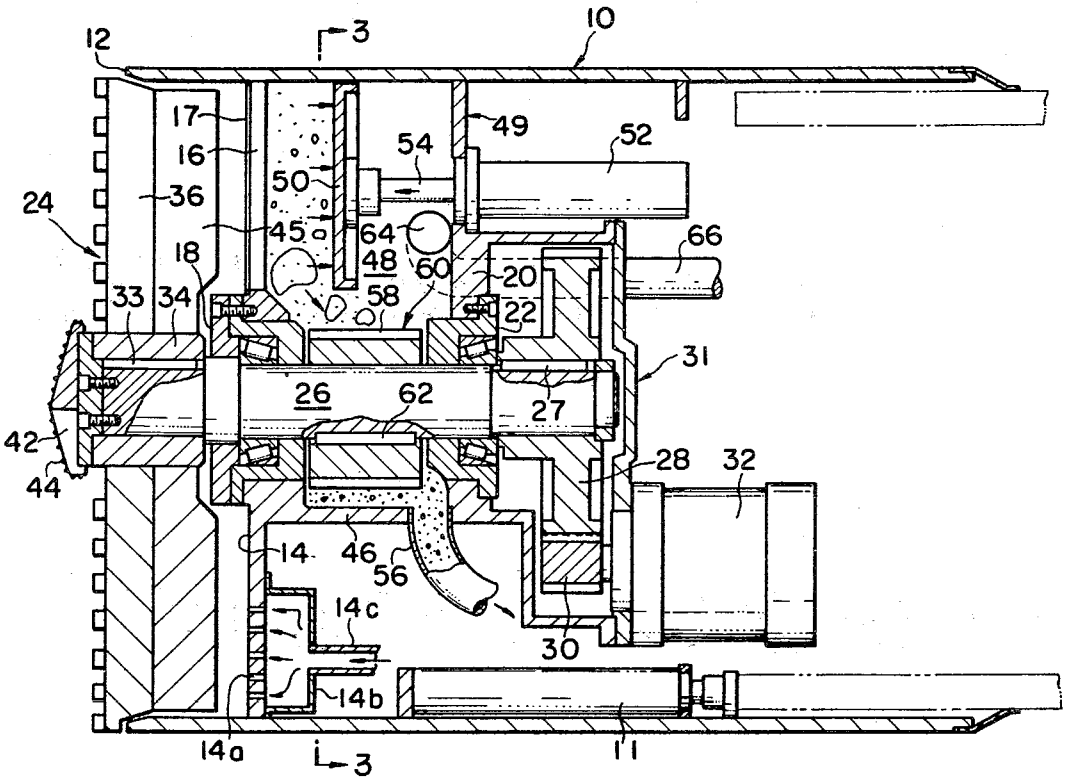
FIG. 1 is a longitudinal cross sectional elevational view of a shield tunneling machine according to the present invention.

A shield body 10 of a shield tunneling machine comprises a a thrust ram or advancing jack 11 and a diaphragm 14 provided internally across the shield body in a portion spaced apart rearward from the front end 12 of the shield body 11. The diaphragm 14 has an upper opening 16 which is a muck inlet. A bit or a scraper 17 is provided in the peripheral portion of the opening 16.

A bearing 18 is provided in the central portion of the diaphragm 14, and another bearing 22 is provided in a wall member 20 disposed substantially in parallel to the diaphragm 14 at the rear thereof and carried by the shield body 10. Both bearings 18 and 22 carry a rotary shaft 26, on one end of which is mounted a spoke type cutter head 24. The cutter head 24 allows admission of the muck between the tunnel face and the diaphragm, without interruption. A main gear 28 is mounted on the other end of the rotary shaft 26 through the medium of a key 27. The main gear is coupled by way of a gear 30 and a reduction gear (not shown) to a reversible motor 32. The gears 28 and 30 are provided in the casing attached to the wall member 20.

Figure 2:
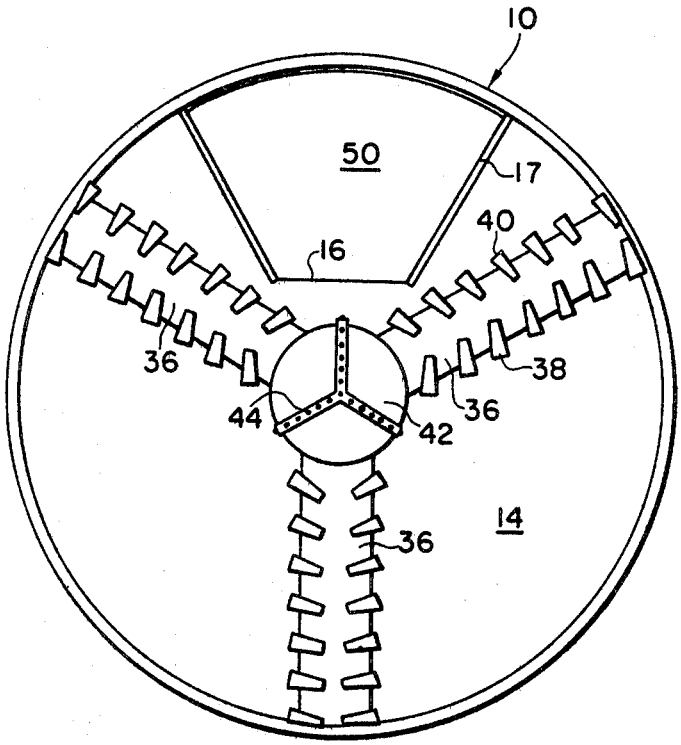
FIG. 2 is a front view of the shield tunneling machine of FIG. 1.

The cutter head 24 comprises three spokes 36 radially extending in three directions from a boss portion 34 fitted on the end of the rotary shaft 26 and fixed thereto through the medium of a key 33. A train of right-turn bits 38 and a train of left-turn bits 40 are attached to the front face of respective spoke, as best seen in FIG. 2. A center cutter 44 is mounted on a cap 42 fitted on the rotary shaft end. Provided at the rear of respective spokes 36 is a rib 45 which serves as an agitating blade for the muck from the tunnel face.

The wall member, the diaphragm 14 and a member 46 interposed therebetween constitute a casing 49 which defines a muck chamber 48 behind the diaphragm, the muck chamber being usually charged with a liquid. The opening 16 in the diaphragm 14 is an inlet through which the muck is introduced into the muck chamber. The muck inlet is closed and opened by a cover member 50.

The cover member 50 is coupled to a piston rod 54 of an operation device consisting of a dual hydraulic piston cylinder device attached to the wall member 20. A hydraulic pressure circuit (not shown) for introducing a liquid pressure of a predetermined level into a cylinder is connected to the operation device 52, in order to retain the piston in a given position within the cylinder so that the cover member 50 may usually close the muck inlet 16. So far as a pressure of the muck charged between the face and the diaphragm 14 is maintained in a level capable of preventing collapse of the face, more specifically within the range of pressure larger than an active earth pressure in the face ground but smaller than a passive earth pressure thereof, the cover member 50 consistently closes the muck inlet 16. When the pressure of the muck is raised over the predetermined level, the cover member 50 is urged by the muck to open the muck inlet 16, thereby allowing admission of the muck into the inlet. As soon as the muck pressure drops to the predetermined level due to admission of the muck into the muck chamber, then the operation device 52 urges the cover member 50 to a close position, whereby the muck inlet 16 is again closed.

As is apparent from the foregoing, the muck inlet 16 is adapted to open and close according to a change in a muck pressure in a manner that only when the muck inlet is opened due to the muck pressure being raised to higher than a predetermined level, the muck is taken into the muck chamber charged with the liquid and positioned behind the diaphragm, and the muck is discharged outside the muck chamber through a muck discharge pipe 56 provide in the casing member 46 in the lower portion of the muck chamber. Discharge of the muck out of the muck chamber is accomplished without changing the muck pressure to a greater extent and hence without causing collapse of the face.

Figure 3:
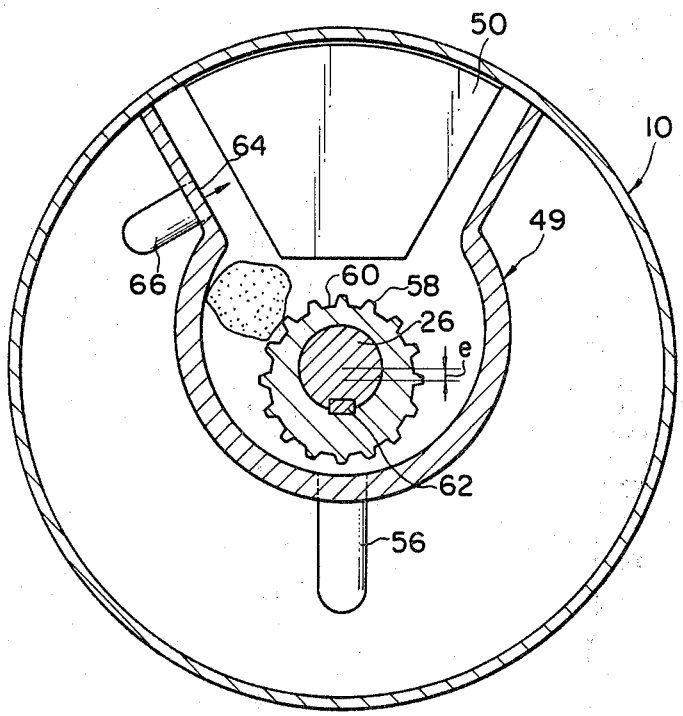
FIG. 3 is a transverse cross sectional view taken along the line 3—3 of FIG. 2.

To meet the case where the muck contains gravels, the muck chamber 48 may be a crushing chamber including a crushing means internally thereof. In this connection, a rotor 60 having crushing teeth 58 must be attached by means of a key 62 to the rotary shaft 26. The wall thickness of the wall members 20 and 46 which constitute the casing 49 surrounding the rotor 60 must be increased to such an extent as sufficiently resists the crushing impact. In order to provide an increased gravel-crushing effect, it is recommended to leave a distance of eccentricity e between the axis of the rotary shaft 26 and the axis of the rotor 60, as shown in FIG. 3, and to attach a liner (not shown) with crushing teeth to the inner wall of the casing 47, as the case may be.

In case the muck chamber is used solely as a chamber for receiving earth from the face, the casing 49 constituting the muck chamber need not accommodate therein the rotary shaft 26, unlike in FIG. 1. In case the muck chamber 48 is used as a crushing chamber equipped with a crushing means, it is advantageous that the rotor 60 be mounted on the rotary shaft 26, so as to be run at a high torque. In the latter case, the crushing chamber surrounding the rotary shaft and the rotor 60 eccentrically mounted on the rotary shaft preferably is formed of the casing 49. This construction is advantageous from the viewpoint of simplicity in construction of the machine itself, because a special drive source for the rotor or a special transmission means from a drive source 32 is not needed.

To the effect that the muck chamber can be usually filled with a liquid, a liquid supply pipe 66 open (as at 64) to the upper portion of the muck chamber is provided, so as to introduce a liquid such as clean water or muddy water into the muck chamber. In case muck containing crushed gravels introduced into the muck chamber is carried by the liquid in the muck chamber to be discharged out of the muck chamber 48 through the muck discharge pipe 56, such a liquid is supplied into the muck chamber 48.

A smoothing material in the liquid state, such as an aqueous solution containing bentonite, may be supplied into part of the front portion of the diaphragm 14, so as to reduce a frictional force acting between the diaphragm and the muck, whereby a resistance to the driving torque, of the cutter head 24 can be reduced. To this end, a plurality of through-holes **14*a* is provided in the lower portion of the diaphragm 14, and a liquid reservoir 14*b* is provided behind the lower portion of the diaphragm, so that the smoothing material may be supplied into the liquid reservoir through a pipe 14*c***.

Figure 4:
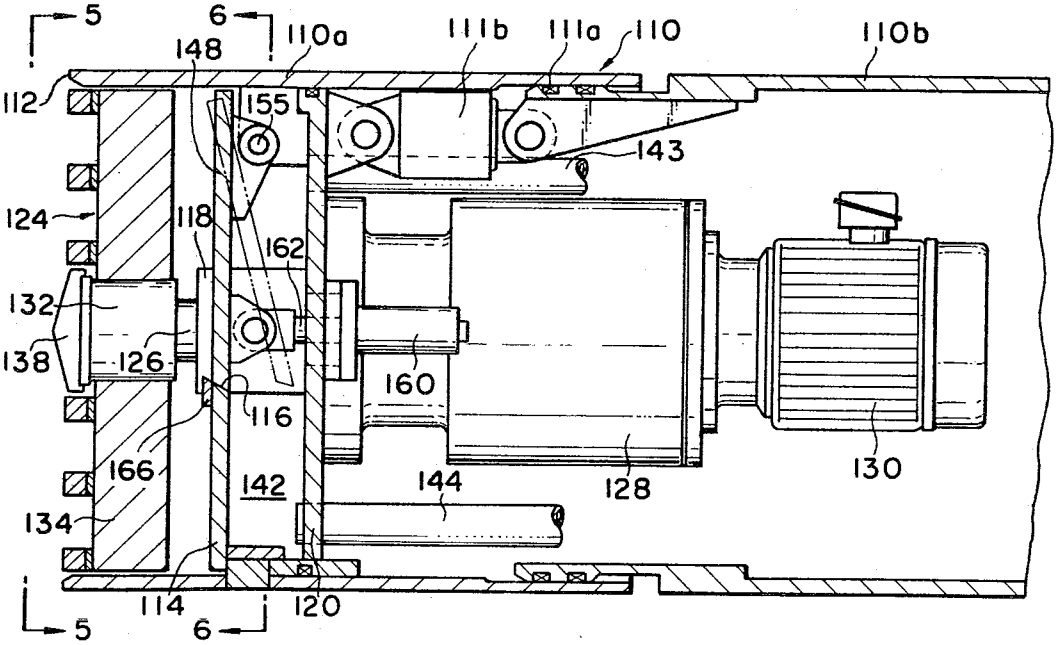
FIG. 4 is a longitudinal cross sectional elevational view of a shield tunneling machine for pipe jacking, to which the present invention is applied.

Referring now to FIG. 4, a shield body 110 of a shield tunneling machine for a pipe jacking comprises a head portion **110*a* and a tail portion 110*b*. The head portion 110*a* is coupled to the tail portion 110*b* liquid-tightly by means of seals 111*a* and pivotally movably by means of four direction adjusting hydraulic jacks 111*b***.

The shield body 110 comprises a diaphragm 114 remote to the rear to some extent from the front portion 112 of the shield body across the shield body. The diaphragm 114 is provided with two openings 116 (FIG. 6) in the upper portion thereof, these openings serving as muck inlets to be described later. A bearing 118 is provided in the central portion of the diaphragm 114. The bearing 118 extends to a stationary wall 120 and is fixed thereto, the stationary wall being located behind the diaphram 114 substantially in parallel thereto and attached to the shield body 110. The bearing 118 carries a rotary shaft 126, on one end of which a spoke type cutter head 124 is mounted. The cutter head 124 allows admission of the muck between the face and the diaphragm 114 without impeding or limiting the free passing of the muck removed from the tunnel face to the rear portion of the shield body. The other end of the rotary shaft 126 is coupled to a reduction gear 128 connected to the fixed wall 120, so that the rotary shaft may receive a drive force from a motor 130.

Figure 5:
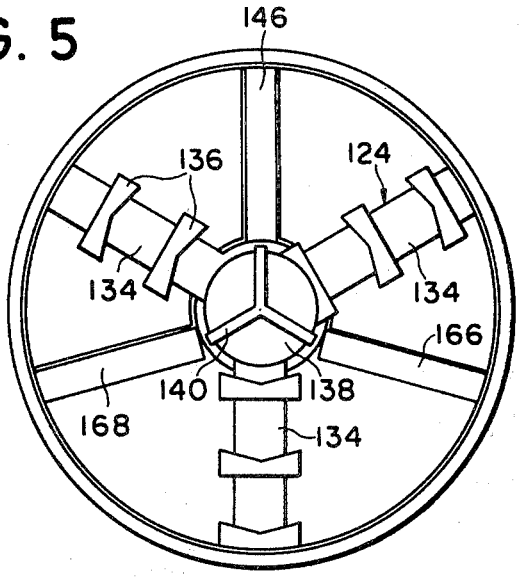
FIG. 5 is a front view, as seen from the line 5—5 of FIG. 4.

The cutter head 124 comprises three spokes 134 extending radially in three directions from a boss portion 132 fitted on one end of the rotary shaft 126 and fixed thereto. A plurality of bits 136 are attached to the front face of respective spokes, as best seen in FIG. 5. A center cutter 140 is provided on a cap 138 fitted on the end of the rotary shaft 126. Bits may be attached to the rear face of respective spokes. These spokes 134 serve as agitating blades for the muck removed from the face.

The diaphragm 114 and the fixed wall 120 define a muck chamber 142. The muck chamber 142 is usually filled with a liquid which is supplied through a supply pipe 143. The muck which is introduced through the openings 116 into the muck chamber 142 are mixed with water or muddy water which is to be supplied by the supply pipe 143 into the muck chamber 142 and discharged out of the muck chamber 142, along with water or muddy water, through the discharge pipe 144 to the outside. The underground water in the face ground does not move, and hence is not discharged, because the pressure of the underground water makes an equilibrium with a pressure of the liquid in the muck chamber 142.

Figure 6:
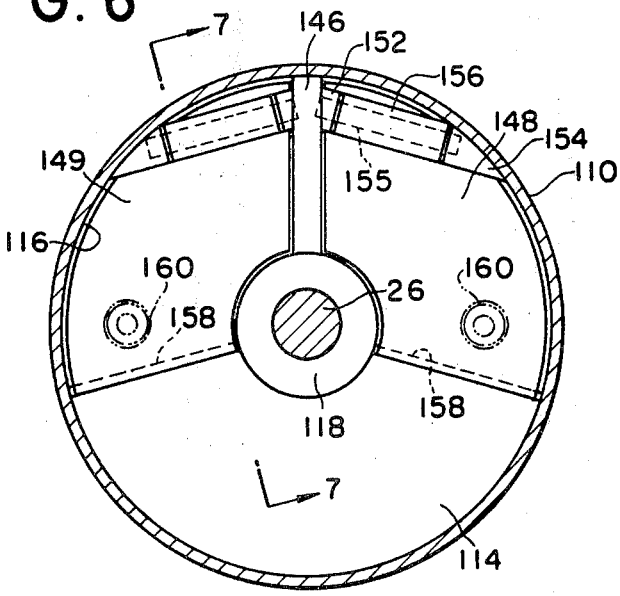
FIG. 6 is a transverse cross sectional view taken along the line 6—6 of FIG. 4.
Figure 7:
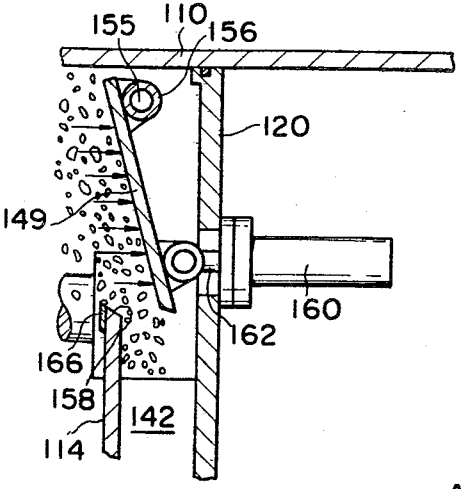
FIG. 7 is a cross sectional view taken along the line 7—7 of FIG. 6.

Two openings 116 are positioned on the opposite sides of a support member 146 projecting upward from the bearing 118, as seen in FIGS. 6 and 7. Respective openings 116 are of a sector-shape. Cover members 148 and 149 for closing and opening these openings 116 are provided.

The cover members 148 and 149 are pivotally movably carried by brackets 156 which in turn are supported on shafts 155, each of which extends between brackets 152 and 154 attached to the support member 146 and the shield body 110, respectively. The shafts 155 and one edge 158 of the openings in the wall member 116 preferably be in parallel to each other, so that forces acting on the cover members when the cover members 148 and 149 are turned to an open position by the muck make equilibrium.

The cover members 148 and 149 are pivotally connected to piston rods 162 of operation devices 160 for cover members which consist of dual hydraulic piston cylinder devices attached to the fixed wall 120, respectively. Both cover members 148 and 149 are similar in operation to each other, and the operation of one cover member 148 alone will be described for the simplicity sake.

A hydraulic circuit (not shown) for introducing a pressure of a predetermined level into the cylinders is connected to respective operation device 160, so as to maintain the piston in a given position within the cylinder so that the cover member 148 can usually close the opening 118. So far as a pressure of the muck filled between the face and the diaphragm 114 is lower than the aforesaid predetermined level, the cover member 148 consistently close the muck inlet. On the other hand, when the muck pressure is increased over the aforesaid predetermined level, the cover member 148 is urged by the muck to be pivotally moved about the shaft 155 to open the muck inlet 116, thereby allowing admission of the muck into the muck chamber. When the muck pressure decreases to less than the aforesaid predetermined level due to the muck admitted into the muck chamber, the operation device 160 again urges the cover member 148 to a close position, thereby closing the opening 116.

The cover member is adapted to open and close the opening 116 according to a change in a muck pressure, and only when the cover member is pivotally moved to an open position as a result of increase of the muck pressure, so that the muck is taken into the muck chamber 142 positioned behind the diaphragm 114, and the muck is transported by a liquid rearward of the shield body through the discharge pipe 144. Discharge of the muck is achieved without greatly changing the muck pressure by the diaphragm 114 and the cover member 148, and hence removal of the muck from the face is achieved without causing collapse of the tunnel face. The cover members 148 and 149 open and close sequentially from the cover member positioned on the upstream side, as viewed in the direction of rotation of the cutter head 124.

Figure 8:
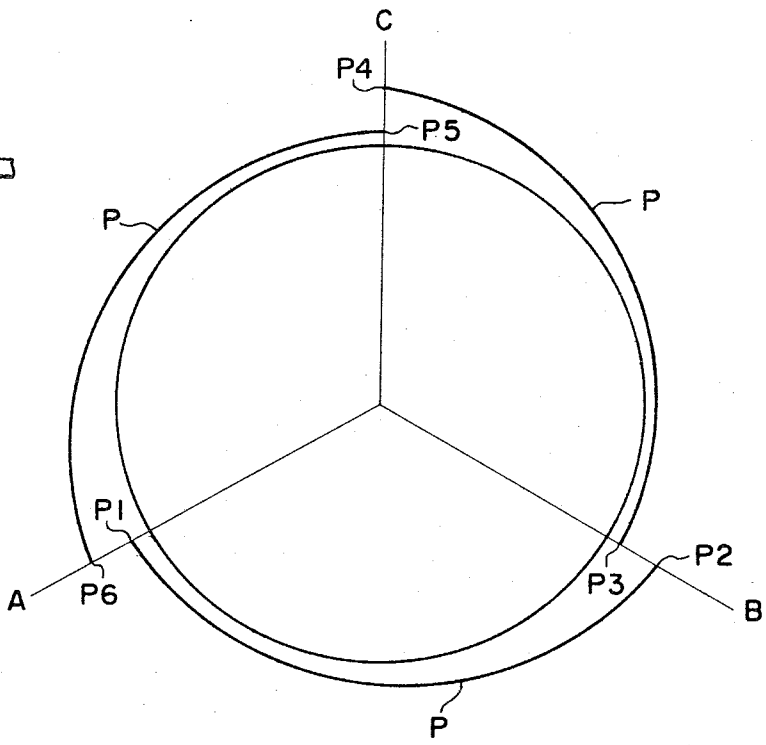
FIG. 8 is an illustration, showing qualitatively the relationship of rotation of a spoke verus the muck pressure.

Operation of the spokes 134 will be referred to below. The cover members 148 and 149 are positioned on the left and right sides of the support member 146, as described with reference to FIG. 6. Assuming that the cutter head 124 is rotated counterclockwise, as viewed from the rear end of the shield body 110, the muck is rotated in the same direction as the cutter head. The muck is thus moved onto the right-side cover member 148 in FIG. 6 and then comes to the left-side cover member 149. Movement of only a spoke 134 will be referred to for the simplicity sake. The qualitative relationship of the movement of one spoke 134 versus the muck pressure is shown in FIG. 8. When the spoke 134 comes to the diaphragm 114 (a point A in FIG. 8) beyond the left-side cover member 149, the muck is turned toward the right-side cover member 148 by the spoke 134 as same is held between the face and the diaphragm 114. For this duration, coupled with the muck removed from the face and the shield body 110 moving forward of the shield, the pressure P of the muck is raised degree by degree from a level P1 to a level P2. When the muck comes to the right-side cover member 148 (a point B in FIG. 8), if the muck pressure is higher than the predetermined level present by the operation device 160, the right-side cover member 148 is moved to an open position by the muck, and the muck is admitted into the muck chamber 142. As a result, the muck pressure is lowered to a level P3. If the muck pressure by no means is lowered to less than the predetermined level, the cover member 148 is maintained in the open position. Thereafter, as the spoke 134 is rotated along the right-side cover member 148, the muck pressure P is gradually increased to a level P4. When the spoke 134 moves over the support member 146 (a point C in FIG. 8), the left-side cover member 149 is in turn turned to an open position by the muck pressure, whereby the muck is discharged through the muck inlet into the muck chamber 142. As a result, the muck pressure P is again lowered to a level P5. Thereafter, the muck pressure is raised to a level P6 as the spoke 134 is rotated, and the muck is discharged into the muck chamber. Consequently, the muck pressure is lowered to the level P1, and the left-side cover member 149 resumes a close position.

By the provision of two cover members 148 and 149, a change of the muck pressure is lessened and distribution of the muck pressure becomes uniform, as compared with the case where the muck is discharged by a single cover member, because the pressure raised by one cover member 148 is lowered by the other cover member 149.

The muck admitted into the muck chamber 142 by the left-side cover member 149 turned to the open position by the movement of the spoke 134 is transported from above toward the diaphragm 114, as seen in FIG. 7. A bit or a scraper 166 is attached to the lower edge of the opening in the diaphragm 114, so that the muck removed from the face by the cutter head 124 is again cut into pieces by the scraper 166, namely, the muck is subjected to the secondary cutting. The muck containing gravels of a relatively large size is cut into pieces by the scraper, for the smooth discharge to the outside of the shield. A bit of a scraper 168 (FIG. 5) attached to the edge of the right-side opening 158 acts in like manner as described above, when the cutter head 124 is rotated clockwise.

Figure 9:
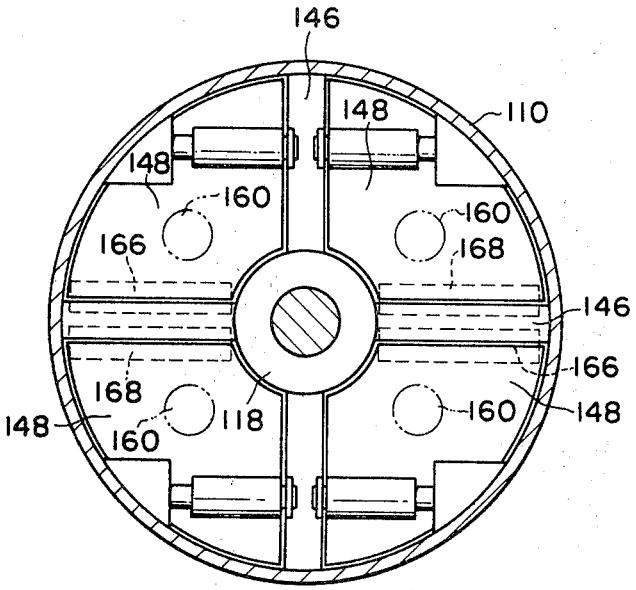
FIG. 9 is a transverse cross sectional view of the machine in the modified form, which is similar to FIG. 6.

FIG. 9 shows another embodiment in which four openings are provided in the diaphragm 114 and cover members 148 for these openings are provided, respectively. In this embodiment, the whole area of the diaphragm 114 is adapted to open and close by the cover members 148. Since respective cover members 148 are maintained in the close positions when the muck pressure is short of the level predetermined by the operation devices 160 attached to the cover members, respectively, a force is permitted to act on the face through the medium of the muck, so as to prevent collapse of the face. In this embodiment, a scraper 166 and a scraper 168 contribute to the secondary cutting of the muck and introduction of the muck into the muck inlets or openings, as in the former example. One scraper 166 operates when the cutter head 124 is rotated counterclockwise, and the other scraper 168 operates when the cutter head 124 is rotated clockwise. The other structure is the same as that of the preceding embodiment.

What is claimed is:

1. A tunneling method characterized by;

introducing muck from tunnel face into a shielded zone;

pressing said muck, by thrusting said shielded zone forwardly, at a pressure of a predetermined level higher than an active earth pressure in the face ground but lower than a passive earth pressure, so as to balance muck pressure with earth pressure in the face ground; and using a liquid as a means for resisting the underground water and pressurizing said liquid to a level balancing the underground water pressure to prevent movement of said underground water;

whereby the tunnel face is maintained stable while the tunneling operation is proceeded, and said muck is discharged out of said shielded zone when said muck pressure is raised over said predetermined level.

2. A shield tunneling method comprising the steps of;

excavating tunnel face by a cutter head (24,124) provided at the front of a shield body (10,110) to be thrusted and allowing the passing of the muck therethrough;

filling said muck mined at the tunnel face between the tunnel face and a diaphragm (14,114) disposed across said shield body and usually maintained closed by an operating means (52,160) and provided with a chamber (48,142) behind said diaphragm, said chamber being filled with a liquid;

pressurizing said muck by forwardly thrusting said shield body, thereby exerting a pressure on the tunnel face with said muck under the pressurized condition;

allowing admission of said muck into said chamber filled with the liquid by opening said diaphragm with said muck, when said pressure is increased to a level higher than a predetermined pressure which is preset at said operating means and which is higher than an active earth pressure in the face ground but lower than a passive earth pressure; and discharging the liquid containing said muck out of said chamber while said liquid is being supplied into said chamber.

3. A shield tunneling method as defined in claim 2, further comprising the step of secondarily cutting said muck into pieces in a space between said cutter head (24,124) and said diaphragm (14,114).

4. A shield tunneling method as defined in claim 2, further comprising the step of crushing gravels contained in said muck into pieces within said chamber (48,142) before discharging the muck out of said chamber.

5. A shield tunneling machine comprising;

a drive shaft (26,126) rotatably carried by a diaphragm (14,114) provided in the front portion of a shield body (10,110) to be thrusted;

a cutter head (24,124) attached to the end of said drive shaft and allowing the passing of muck therethrough;

a muck chamber (48,142) defined behind said diaphragm;

a muck inlet (16,116) provided in said diaphragm;

a cover member (50,148,149) adapted to open and close said muck inlet;

an operating means (52,160) adapted to exert on said cover member a pressure of a predetermined level higher than an active earth pressure in the face ground but lower than a passive earth pressure, thereby displacing said cover member to close said muck inlet, and adapted to displace said cover member to open said muck inlet when the pressure acting on said diaphragm and said cover member by the muck admitted into said shield body is raised over said predetermined level;

means (66,143) for supplying a liquid into said muck chamber, so that said muck chamber is usually filled with the liquid; and means (56,144) for transporting the liquid containing the muck out of said muck chamber.

6. A shield tunneling machine as defined in claim 5, further comprising; a rotor (60) for crushing gravels contained in said muck, said rotor being mounted on said rotary shaft (26) at the rear of said diaphragm (14); and said muck inlet (16) being provided in the upper portion of said diaphragm.

7. A shield tunneling machine as defined in claim 5, said cutter head being of a spoke type.

8. A shield tunneling machine as defined in claim 5, wherein said diaphragm (114) is provided with two or mor muck inlets (116), and said muck inlets are adapted to open sequentially by said muck for a duration which said cutter head is rotated.

9. A shield tunneling machine as defined in claim 5, wherein said diaphragm (114) is provided with a pair of muck inlets (114), and one of said pair of muck inlets is opened by said muck according to a direction of rotation of said cutter head during rotation thereof.

10. A shield tunneling machine as defined in claim 5, wherein said diaphragm (114) consists of two or more movable cover members (148), and said cover members are sequentially open by said muck during rotation of said cutter head.

11. A shield tunneling machine as defined in claim 5, further comprising;

means (**14*a*,14*b*,14*c***) for supplying a smoothing material in the liquid state to the front portion of said diaphragm, so as to reduce the frictional force acting between said muck and said diaphragm.

12. A shield tunneling machine as defined in any of claims 5,6,7 or 9, wherein said diaphragm includes a scraper (17,166,168) attached to the edge of said muck inlet.

* * * * *